US010971845B2

(12) United States Patent
Lu et al.

(10) Patent No.: US 10,971,845 B2
(45) Date of Patent: Apr. 6, 2021

(54) RECTANGULAR IMPACT-RESISTANT ELASTIC CONNECTOR

(71) Applicant: SHENZHEN SUNWAY COMMUNICATION CO., LTD., Guangdong (CN)

(72) Inventors: Haiqiu Lu, Guangdong (CN); Mavis Ma, Guangdong (CN); Chengxue Liang, Guangdong (CN)

(73) Assignee: SHENZHEN SUNWAY COMMUNICATION CO., LTD., Guangdong (CN)

( * ) Notice: Subject to any disclaimer, the term of this patent is extended or adjusted under 35 U.S.C. 154(b) by 139 days.

(21) Appl. No.: 16/305,634

(22) PCT Filed: Apr. 25, 2017

(86) PCT No.: PCT/CN2017/081807
§ 371 (c)(1),
(2) Date: Nov. 29, 2018

(87) PCT Pub. No.: WO2017/206627
PCT Pub. Date: Dec. 7, 2017

(65) Prior Publication Data

US 2020/0335896 A1 Oct. 22, 2020

(30) Foreign Application Priority Data

May 31, 2016 (CN) ..... 201610377780.0

(51) Int. Cl.
*H01R 13/24* (2006.01)

(52) U.S. Cl.
CPC ..... *H01R 13/2407* (2013.01)

(58) Field of Classification Search
CPC ..... H01R 13/2407
See application file for complete search history.

(56) References Cited

U.S. PATENT DOCUMENTS 6,572,386 B1 6/2003 Howell et al.
7,527,536 B2 * 5/2009 Chiang ..... H05K 7/1069 439/884

(Continued)

FOREIGN PATENT DOCUMENTS

CN 2519428 Y 10/2002
CN 2519428 Y 10/2002

(Continued)

*Primary Examiner* — Ross N Gushi
(74) *Attorney, Agent, or Firm* — Rabin & Berdo, P.C.

(57) ABSTRACT

A rectangular impact-resistant elastic connector includes an upper contact part, first and second side plates, first and second S-shaped lift force arms and a bottom plate, wherein the first and second side plates are connected with the bottom plate, the first S-shaped lift force arm has an end connected with the upper contact part and an end connected with one end of the first side plate, and the second S-shaped lift force arm has an end suspended below the upper contact part and an end connected with one end of the second side plate. The S-shaped lift force arm structures having the advantage of greater elasticity over other force arm structures under the same unit size are used to provide an elastic force, so that the size of the connector is reduced. The side plates protect the force arms, thus, improving the overall impact resistance of the connector.

13 Claims, 4 Drawing Sheets

(56) References Cited

U.S. PATENT DOCUMENTS

| | | | | |
|---|---|---|---|---|
| 7,563,105 | B2 * | 7/2009 | Liu | H01R 13/2492 439/66 |
| 7,857,632 | B2 * | 12/2010 | Liu | H01R 13/2492 439/66 |
| 9,912,090 | B2 * | 3/2018 | Yokota | H01R 13/2407 |
| 9,997,855 | B2 * | 6/2018 | Yokota | H01R 13/2407 |
| 10,003,147 | B2 * | 6/2018 | Yokota | H01R 13/2407 |
| 10,008,801 | B2 * | 6/2018 | Yokota | H01R 13/2407 |
| 10,116,071 | B2 * | 10/2018 | Li | H01R 12/714 |
| 10,446,966 | B2 * | 10/2019 | Mori | H01R 13/2457 |

FOREIGN PATENT DOCUMENTS

| | | | |
|---|---|---|---|
| CN | 2567807 | Y | 8/2003 |
| CN | 2587076 | Y | 11/2003 |
| CN | 1744389 | A | 3/2006 |
| CN | 200994012 | Y | 12/2007 |
| CN | 101425631 | A | 5/2009 |
| CN | 204558722 | U | 8/2015 |
| CN | 204558722 | U | 8/2015 |
| CN | 105098432 | A | 11/2015 |
| CN | 105098432 | A | 11/2015 |
| CN | 204809469 | U | 11/2015 |
| CN | 204809469 | U | 11/2015 |
| CN | 105490053 | A | 4/2016 |
| CN | 105490053 | A | 4/2016 |
| CN | 105938949 | A | 9/2016 |
| CN | 105938949 | A | 9/2016 |
| CN | 205790545 | U | 12/2016 |
| CN | 205790545 | U | 12/2016 |
| EP | 2403070 | A1 | 1/2012 |
| KR | 101415306 | B1 | 7/2014 |
| KR | 101415306 | B1 | 7/2014 |

* cited by examiner

RECTANGULAR IMPACT-RESISTANT ELASTIC CONNECTOR

TECHNICAL FIELD

The invention relates to elastic connectors, in particular to a rectangular impact-resistant elastic connector.

DESCRIPTION OF RELATED ART

With the continuous development of electronic technologies, various electronic devices with connectors as indispensable components have been produced. The connectors are used as communication bridges at off positions in circuits or between isolated circuits to allow currents to pass through the circuits, thus, fulfilling preset functions of the circuits. For different application objects, frequencies, powers, application environments and the like, the connectors can be of various forms and structures. In the prior art, small-sized connectors are poor in impact resistance and insufficient in elasticity, while connectors with high impact resistance and large elasticity usually have a large size, which deviates from the development direction of the connectors towards miniaturization. Thus, it is urgently necessary to develop a connector having a small size, large elasticity and high impact resistance.

Patent Application No. 201510257309.3 disclosed a crimp connector shown in FIG. 1 and a method for manufacturing the crimp connector. As shown in FIG. 1, two L-shaped parts 1*q* extend out from two opposite edges of a lower flat plate part 1*b* of the connector, and the two L-shaped parts 1*q* are spirally coiled and stretched towards the center to form a first spring part 1*c* and a second spring part 1*d*. As for the method for manufacturing the crimp connector, the two spring parts are coiled to be in a spiral shape first and then are bent to be located above the bottom plate uprightly with respect to the bottom plate. This scheme has the following defects: when the spring parts are bent to be upright, the spring part latterly coiled has to enter a spiral gap of the other coiled spring part, and for this reason, a large spiral gap or a small vertical width of the spring parts is needed. The spring parts will occupy a large horizontal area due to the large gap, which is not in conformity with the requirement for miniaturization of the connector. The small vertical width of the spring parts will result in small elasticity of the connector, and consequentially, the elasticity fails to reach the standard.

BRIEF SUMMARY OF THE INVENTION

The technical issue to be settled by the invention is to provide a connector which is small in size, large in elasticity and high in impact resistance.

The following technical solution is adopted by the invention to settle the above technical issue. A rectangular impact-resistant elastic connector comprises an upper contact part, a first side plate, a second side plate, a first S-shaped lift force arm, a second S-shaped lift force arm and a bottom plate. The first side plate and the second side plate are connected with the bottom plate. The first S-shaped lift force arm has an end connected with the upper contact part and an end connected with one end of the first side plate. The second S-shaped lift force arm has an end suspended below the upper contact part and an end connected with one end of the second side plate.

The following technical solution is further adopted by the invention. A rectangular impact-resistant elastic connector comprises an upper contact part, a first side plate, a first S-shaped lift force arm and a bottom plate. The first side plate comprises a first part of the first side plate and a second part of the first side plate, wherein the first part and the second part of the first side plate are perpendicularly connected with each other. The first part of the first side plate is in an L shape and has a short edge with an end connected with the bottom plate and a long edge with an end connected with the first S-shaped lift force arm, and the outer side of the short edge of the first part of the first side plate is connected with the second part of the first side plate.

The invention has the following beneficial effects: the S-shaped lift force arm structures which have the advantage of greater elasticity over other force arm structures under the same unit size are used to provide an elastic force, so that the size of the connector is reduced, and the connector is made small and forms a mini rectangular impact-resistant elastic connector; and the side plates can protect the S-shaped lift force arms, and thus, the requirement for impact resistance of the S-shaped lift force arms is met.

REFERENCE SIGNS

1. upper contact part;
2. first part of first side plate;
3. second part of first side plate;
4. first part of second side plate;
5. second part of second side plate;
6. first S-shaped lift force arm;
7. second S-shaped lift force arm;
8. bottom plate;
9. third side plate;
10. fourth side plate;
11. through hole;
12. bent part;
13. protrusion;
14. convex edge;
15. extension part.

DETAILED DESCRIPTION OF THE INVENTION

The key conception of the invention lies in that S-shaped lift force arm structures which have the advantage of greater elasticity over other force arm structures under the same unit size are used to provide an elastic force, so that the size of a connector is reduced, and the connector is made small.

Figure 1:
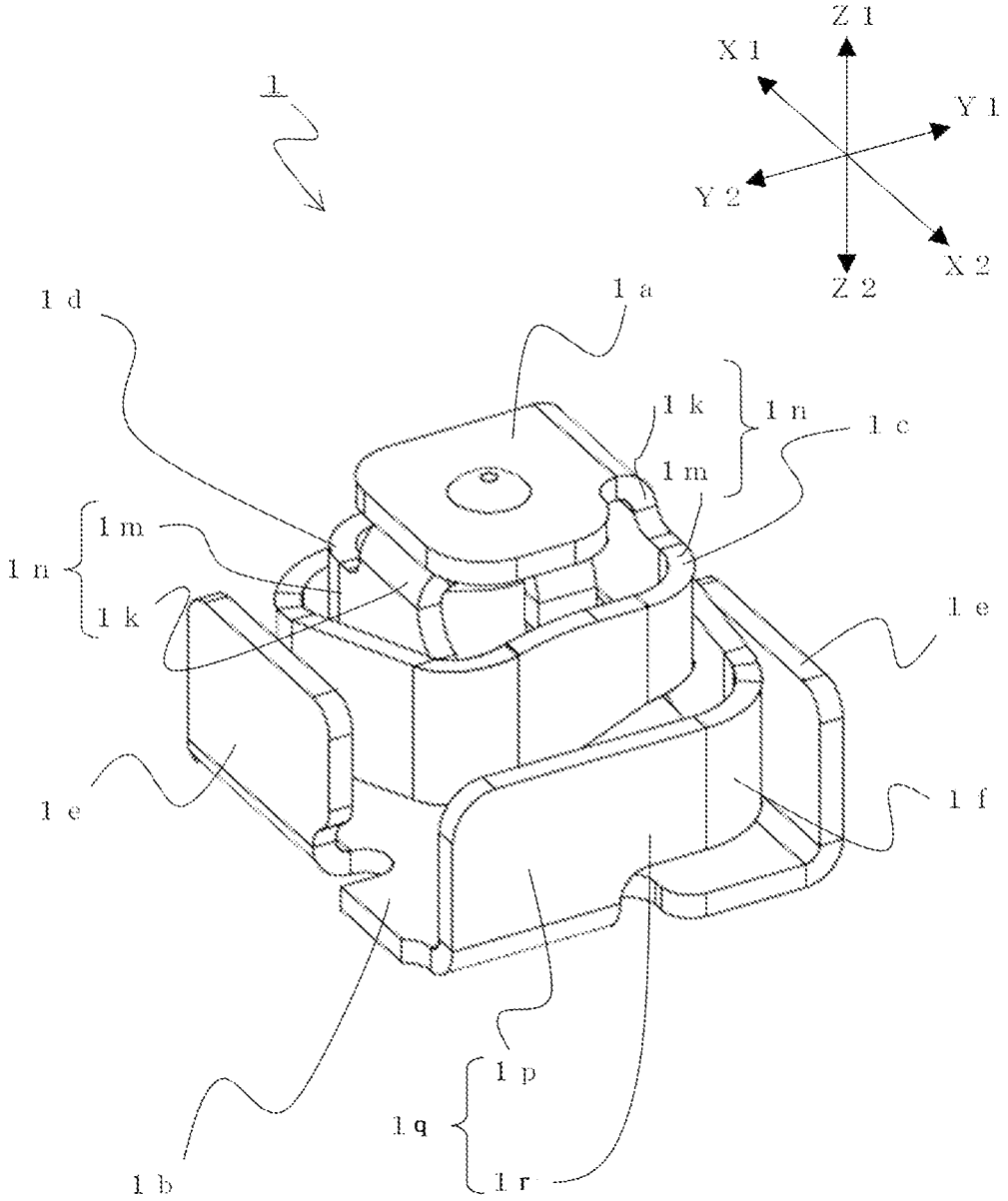
FIG. 1 RELATED ART
FIG. 1 is an overall view of a connector in the prior art.
Figure 2:
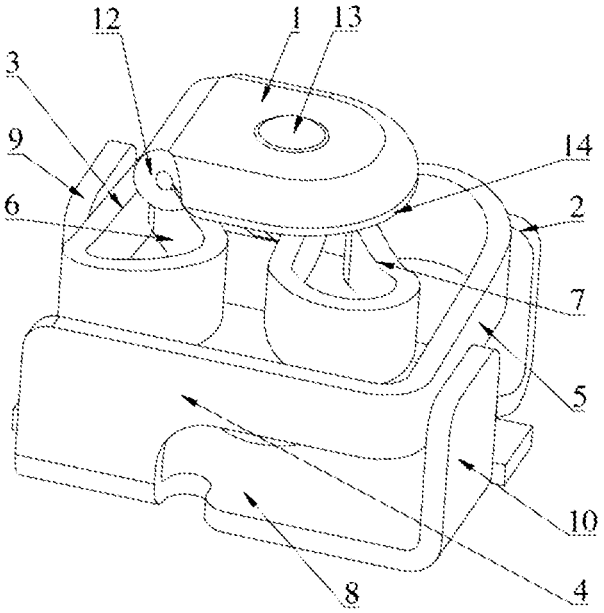
FIG. 2 is an overall view of a connector in embodiment 1.

Referring to FIG. 1 and FIG. 2, a rectangular impact-resistant elastic connector comprises an upper contact part, a first side plate, a second side plate, a first S-shaped lift force arm, a second S-shaped lift force arm and a bottom plate. The first side plate and the second side plate are connected with the bottom plate. The first S-shaped lift force arm has an end connected with the upper contact part and an end connected with one end of the first side plate. The second S-shaped lift force arm has an end suspended below the upper contact part and an end connected with one end of the second side plate.

From the above description, the invention has the following beneficial effects: the S-shaped lift force arm structures which have the advantage of greater elasticity over other force arm structures under the same unit size are used to provide an elastic force, so that the size of the connector is reduced, and the connector is made small; and the side plates are configured to protect the S-shaped lift force arms, and thus, the requirement for impact resistance of the S-shaped lift force arms is met.

Furthermore, the first side plate comprises a first part of the first side plate and a second part of the first side plate, wherein the first part and the second part of the first side plate are perpendicularly connected with each other. The first part of the first side plate is in an L shape and has a short edge with an end connected with the bottom plate and a long edge with an end connected with one end of the second part of the first side plate, and the other end of the second part of the first side plate is connected with the first S-shaped lift force arm. The second side plate comprises a first part of the second side plate and a second part of the second side plate, wherein the first part and the second part of the second side plate are perpendicularly connected with each other. The first part of the second side plate is in an L shape and has a short edge with an end connected with the bottom plate and a long edge with an end connected with one end of the second part of the second side plate, and the other end of the second part of the second side plate is connected with the second S-shaped lift force arm.

Furthermore, the first side plate and the second side plate are respectively connected with two opposite edges of the bottom plate.

Furthermore, the rectangular impact-resistant elastic connector further comprises a third side plate and a fourth side plate, wherein the third side plate is located on the outer side of the second part of the first side plate and is connected with the bottom plate, and the fourth side plate is located on the outer side of the second part of the second side plate and is connected with the bottom plate.

From the above description, the two opposite S-shaped lift force arm structures are used to provide a sufficient elastic force for the contact part, and the third side plate and the fourth side plate are arranged on the outer sides of the force arms to comprehensively protect the S-shaped lift force arm structures.

Furthermore, the first side plate comprises a first part of the first side plate and a second part of the first side plate, wherein the first part and the second part of the first side plate are perpendicularly connected with each other. The first part of the first side plate is in an L shape and has a short edge with an end connected with the bottom plate and a long edge with an end connected with the first S-shaped lift force arm, and the outer side of the short edge of the first part of the first side plate is connected with the second part of the first side plate.

The second side plate comprises a first part of the second side plate and a second part of the second side plate, wherein the first part and the second part of the second side plate are perpendicularly connected with each other. The first part of the second side plate is in an L shape and has a short edge with an end connected with the bottom plate and a long edge with an end connected with the second S-shaped lift force arm, and the outer side of the short edge of the first part of the second side plate is connected with the second part of the second side plate.

Furthermore, the second part of the first side plate and the second part of the second side plate correspond to the same edge or opposite edges of the bottom plate.

From the above description, the two opposite S-shaped lift force arm structures can provide a sufficient force for the contact part, and the force arms have sufficient moving spaces, so that the machining difficulty is lowered.

The invention further provides a rectangular impact-resistant elastic connector comprising an upper contact part, a first side plate, a first S-shaped lift force arm and a bottom plate. The first side plate comprises a first part of the first side plate and a second part of the first side plate, wherein the first part and the second part of the first side plate are perpendicularly connected with each other. The first part of the first side plate is in an L shape and has a short edge with an end connected with the bottom plate and a long edge with an end connected with the first S-shaped lift force arm, and the outer side of the short edge of the first part of the first side plate is connected with the second part of the first side plate.

From the above description, invention has the following beneficial effects: the S-shaped lift force arm structure which has the advantage of greater elasticity over other force arm structures under the same unit size is used to provide an elastic force, so that the size of the connector is reduced, and the connector is made small; and the side plates can protect the S-shaped lift force arm, so that the requirement for impact resistance of the S-shaped lift force arm is met; and meanwhile, only one S-shaped lift force arm is adopted, so that the connector has a smaller size, meets more requirements and has a wider application range.

Furthermore, the bottom plate is provided with one or more through holes.

From the above description, the through holes in the bottom plate can prevent cold joints, so that the adhesive force of the connector is obviously improved after the connector adheres to a soldering block.

Furthermore, a joint of the first part and the second part, which are perpendicularly connected with each other, of the first side plate and/or a joint of the first part and the second part, which are perpendicularly connected with each other, of the second side plate are/is rounded corners.

From the above description, the rounded corners are beneficial to elimination of a bending stress.

Embodiment 1

Figure 3:
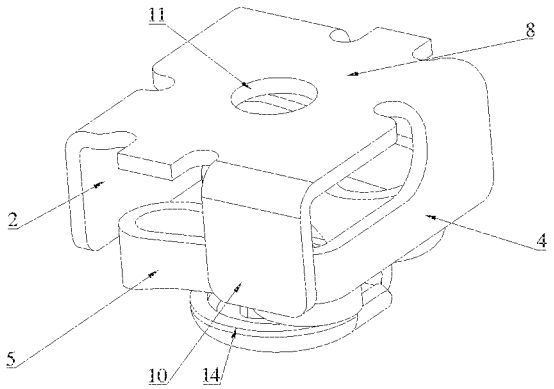
FIG. 3 is a bottom view of the connector in embodiment 1.
Figure 4:
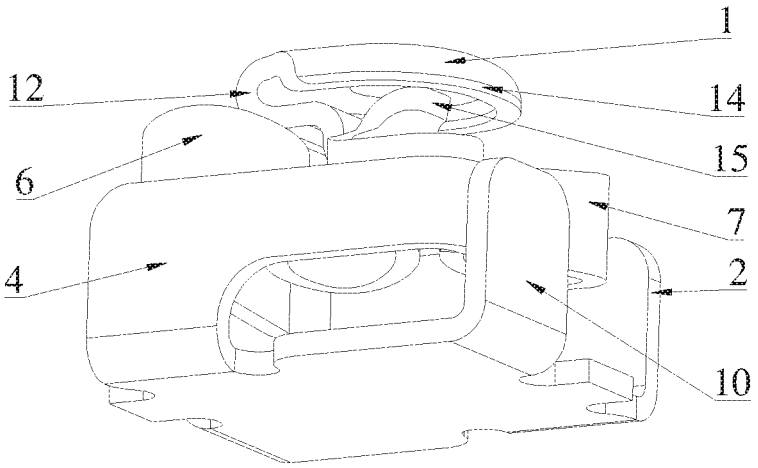
FIG. 4 is a front-top view of the connector in embodiment 1.

Referring to FIG. 2, FIG. 3 and FIG. 4, a two-sided rectangular impact-resistant elastic connector in embodiment 1 is preferably a mini rectangular impact-resistant elastic connector and comprises an upper contact part 1, a first side plate, a second side plate, a first S-shaped lift force arm 6, a second S-shaped lift force arm 7 and a square bottom plate 8 parallel to the upper contact part 1. The center of the upper contact part 1 and the center of the square bottom plate 8 are located on the same vertical line. A protrusion 13 is disposed at the center of the upper surface of the upper contact part 1, and the upper contact part 1 can be pressed through the protrusion 13. A circular convex edge 14 towards the bottom plate is arranged on the outer edge of the lower surface of the upper contact part 1. The bottom plate 8 is preferably square, so that the SMT welding area at the bottom is larger, and the adhesive force of the connector is obviously improved after the connector adheres to a soldering block. The bottom plate 8 may be provided with one or more through holes according to actual requirements so as to prevent cold joints. In this embodiment, one through hole 11 is formed in the center of the bottom plate 8.

Each S-shaped lift force arm is in an S shape on the whole and has two ends spaced from the bottom plate by different distances, which means that each S-shaped lift force arm spirally extends upwards in an S shape.

The first side plate and the second side plate are respectively connected with one set of opposite edges of the bottom plate 8, and a joint between the first side plate and the bottom plate and a joint between the second side plate and the bottom plate are preferably located at two opposite corners of the bottom plate. The upper end of the first S-shaped lift force arm 6 is connected with one edge of the upper contact part 1 through a bent part 12, and the other end of the first S-shaped lift force arm 6 is connected with one end of the first side plate. The second S-shaped lift force arm 7 is symmetrical with the first S-shaped lift force arm 6 with respect to the center of the connector. One end of the second S-shaped lift force arm 7 is suspended below the upper contact part 1 and is provided with an extension part 15, so that the second S-shaped lift force arm 7 can better support the upper contact part 1 in work. The other end of the second S-shaped lift force arm 7 is connected with one end of the second side plate. One of the two S-shaped lift force arms is connected with the upper contact part, while the other S-shaped lift force arm is not connected with the upper contact part, so that pressing limitations caused by inconsistent pressing changes to the two S-shaped lift force arms are avoided.

The first side plate comprises a first part 2 of the first side plate and a second part 3 of the first side plate, wherein the first part 2 and the second part 3 of the first side plate are perpendicularly connected with each other. The first part 2 of the first side plate is in an L shape and has a short edge with an end (namely the end part of the short edge) connected with the bottom plate and a long edge with an end (namely the end part of the long edge) connected with one end of the second part 3 of the first side plate, and the other end of the second part 3 of the first side plate is connected with the first S-shaped lift force arm 6. The second side plate comprises a first part 4 of the second side plate and a second part 5 of the second side plate, wherein the first part 4 and the second part 5 of the second side plate are perpendicularly connected with each other. The first part of the second side plate is in an L shape and has a short edge with an end (namely the end part of the short edge) connected with the bottom plate and a long edge with an end (namely the end part of the long edge) connected with one end of the second part 5 of the second side plate, and the other end of the second part 5 of the second side plate is connected with the second S-shaped lift force arm 7. The first part of the first side plate, the second part of the first side plate, the first part of the second side plate and the second part of the second side plate respectively correspond to the four edges of the bottom plate. A joint between the first part and the second part, which are perpendicularly connected with each other, of the first side plate and a joint between the first part and the second part, which are perpendicularly connected with each other, of the second side plate are rounded corners, which are beneficial to elimination of a bending stress and improve the strength of the joints.

Furthermore, in this embodiment, the elastic connector may further comprise a third side plate 9 and a fourth side plate 10, wherein the third side plate 9 is located on the outer side of the second part 3 of the first side plate and is connected with the bottom plate 8, and the fourth side plate 10 is located on the outer side of the second part 5 of the second side plate and is connected with the bottom plate 8. The four side plates are four side impact-resistant protective arms and have very good impact resistance. When the connector is impacted by an external force, the four side impact-resistant protective arms can comprehensively protect the force arms being squeezed, thus, having a good impact-resistant effect.

Figure 5:
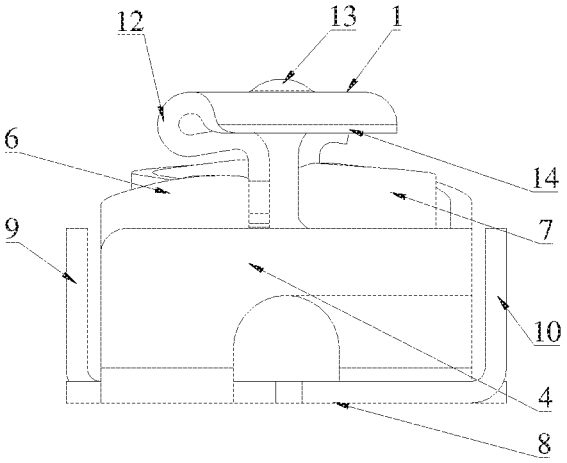
FIG. 5 is a view of the connector in a free state in embodiment 1 of the invention.
Figure 6:
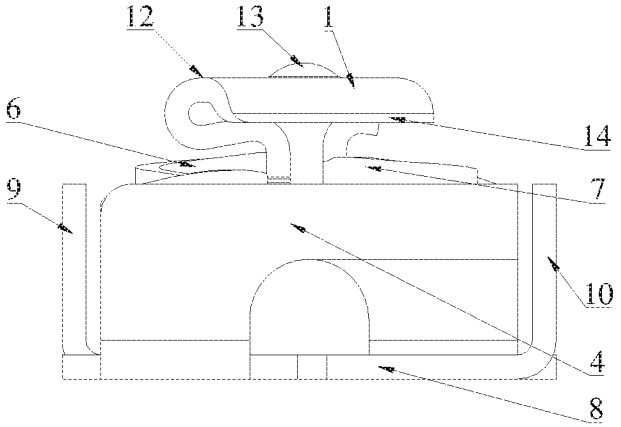
FIG. 6 is a view of the connector in a compressed state in embodiment 1 of the invention.

FIG. 5 is a view of the elastic connector in a free state in this embodiment. As shown in FIG. 5, when the elastic connector is in the free state, the upper end of the second S-shaped lift force arm is suspended and does not make contact with the upper contact part 1. When the upper contact part is pressed downwards with a force, the upper contact part makes contact with the second S-shaped lift force arm, and the two lift force arms move downwards under pressure, as shown in FIG. 6.

Embodiment 2

Figure 7:
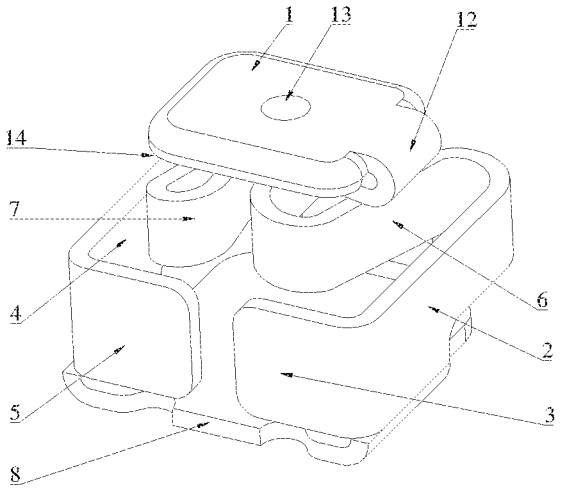
FIG. 7 is an overall view of a connector in embodiment 2.

Embodiment 2 is identical with embodiment 1 in basic structure and is another implementation of the invention. Referring to FIG. 7, embodiment 2 differs from embodiment 1 in that the first side plate and the second side plate are of different structures, particularly:

The first side plate comprises a first part 2 of the first side plate and a second part 3 of the first side plate, wherein the first part 2 and the second part 3 of the first side plate are perpendicularly connected with each other, the first part 2 of the first side plate is in an L shape and has a short edge with an end (namely the end part of the short edge) connected with the bottom plate and a long edge with an end (namely the end part of the long edge) connected with the first S-shaped lift force arm, and the outer side of the short edge of the first part 2 of the first side plate is connected with the second part 3 of the first side plate;

the second side plate comprises a first part 4 of the second side plate and a second part 5 of the second side plate, wherein the first part 4 and the second part 5 of the second side plate are perpendicularly connected with each other, the first part 4 of the second side plate is in an L shape and has a short edge with an end (namely the end part of the short edge) connected with the bottom plate and a long edge with an end (namely the end part of the long edge) connected with the second S-shaped lift force arm, and the outer side of the short edge of the first part 4 of the second side plate is connected with the second part 5 of the second side plate.

As shown in FIG. 7, the second part 3 of the first side plate and the second part 5 of the second side plate correspond to one edge of the bottom plate. Optionally, the second part 3 of the first side plate and the second part 5 of the second side plate may respectively correspond to opposite edges of the bottom plate.

Embodiment 3

Figure 8:
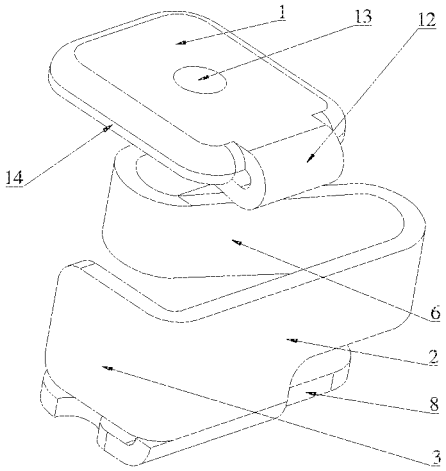
FIG. 8 is an overall view of a connector in embodiment 3.

This embodiment is simplified on the basis of embodiment 2 and provides a one-sided rectangular impact-resistant elastic connector, which is provided with one S-shaped lift force arm and is suitable for a soldering block with a smaller welding area. Referring to FIG. 8, embodiment 3 of the invention is as follows:

A rectangular impact-resistant elastic connector comprises an upper contact part 1, a first side plate, a first S-shaped lift force arm 6 and a bottom plate 8. The first side plate comprises a first part 2 of the first side plate and a second part 3 of the first side plate, wherein the first part 2 and the second part 3 of the first side plate are perpendicularly connected with each other. The first part 2 of the first side plate is in an L shape and has a short edge with an end (namely the end part of the short edge) connected with the bottom plate and a long edge with an end (namely the end part of the long edge) connected with the first S-shaped lift force arm, and the outer side of the short edge of the first part 2 of the first side plate is connected with the second part 3 of the first side plate. The first S-shaped lift force arm is connected with the upper contact part 1 through a bent part 12. Correspondingly, the bottom plate and the upper contact part may be rectangular in this embodiment, and sizes and shapes of the bottom plate and the upper contact part can be correspondingly set according to the size of the single S-shaped lift force arm.

The one-sided rectangular impact-resistant elastic connector in this embodiment has a smaller size and a wider application range and can meet more requirements.

In conclusion, the rectangular impact-resistant elastic connector is small in size, large in elasticity and high in impact resistance; the S-shaped lift force arms are used to obtain a greater elastic force under the same unit size, and thus, the connector is made small; the side plates can comprehensively protect the force arms so as to improve the impact resistance of the connector; the through holes in the bottom plate can prevent cold joints, and thus, the adhesive force of the connector is obviously improved after the connector adheres to a soldering block; and the rounded corners are beneficial to elimination of a bending stress, the process is simple, and the connector is convenient to machine.

The invention claimed is:

1. An elastic connector, comprising an upper contact part, a first side plate, a second side plate, a first S-shaped lift force arm, a second S-shaped lift force arm and a bottom plate, wherein the first side plate and the second side plate are connected with the bottom plate, the first S-shaped lift force arm has an end connected with the upper contact part and an end connected with one end of the first side plate, and the second S-shaped lift force arm has an end suspended below the upper contact part and an end connected with one end of the second side plate; and wherein the bottom plate is provided with one or more through holes.

2. The elastic connector according to claim 1, wherein:

the first side plate comprises a first part of the first side plate and a second part of the first side plate, the first part and the second part of the first side plate are perpendicularly connected with each other, the first part of the first side plate is in an L shape and has a short edge with an end connected with the bottom plate and a long edge with an end connected with one end of the second part of the first side plate, and the second part of the first side plate has an end connected with the first S-shaped lift force arm;

the second side plate comprises a first part of the second side plate and a second part of the second side plate, the first part and the second part of the second side plate are perpendicularly connected with each other, the first part of the second side plate is in an L shape and has a short edge with an end connected with the bottom plate and a long edge with an end connected with one end of the second part of the second side plate, and the second part of the second side plate has an end connected with the second S-shaped lift force arm.

3. The elastic connector according to claim 2, wherein:

the first side plate and the second side plate are respectively connected with two opposite edges of the bottom plate.

4. The elastic connector according to claim 3, wherein:

the rectangular impact-resistant elastic connector further comprises a third side plate and a fourth side plate, the third side plate is located on an outer side of the second part of the first side plate and is connected with the bottom plate, and the fourth side plate is located on an outer side of the second part of the second side plate and is connected with the bottom plate.

5. The elastic connector according to claim 4, wherein a joint of the first part and the second part, which are perpendicularly connected with each other, of the first side plate and/or a joint of the first part and the second part, which are perpendicularly connected with each other, of the second side plate are/is rounded corners.

6. The elastic connector according to claim 2, wherein a joint of the first part and the second part, which are perpendicularly connected with each other, of the first side plate and/or a joint of the first part and the second part, which are perpendicularly connected with each other, of the second side plate are/is rounded corners.

7. The elastic connector according to claim 3, wherein a joint of the first part and the second part, which are perpendicularly connected with each other, of the first side plate and/or a joint of the first part and the second part, which are perpendicularly connected with each other, of the second side plate are/is rounded corners.

8. The elastic connector according to claim 1, wherein:

the first side plate comprises a first part of the first side plate and a second part of the first side plate, the first part and the second part of the first side plate are perpendicularly connected with each other, the first part of the first side plate is in an L shape and has a short edge with an end connected with the bottom plate and a long edge with an end connected with the first S-shaped lift force arm, and an outer side of the short edge of the first part of the first side plate is connected with the second part of the first side plate;

the second side plate comprises a first part of the second side plate and a second part of the second side plate, the first part and the second part of the second side plate are perpendicularly connected with each other, the first part of the second side plate is in an L shape and has a short edge with an end connected with the bottom plate and a long edge with an end connected with the second S-shaped lift force arm, and an outer side of the short edge of the first part of the second side plate is connected with the second part of the second side plate.

9. The elastic connector according to claim 8, wherein:

the second part of the first side plate and the second part of the second side plate correspond to a same edge of the bottom plate.

10. The elastic connector according to claim 8, wherein:

the second part of the first side plate and the second part of the second side plate correspond to opposite edges of the bottom plate.

11. The elastic connector according to claim 8, wherein a joint of the first part and the second part, which are perpendicularly connected with each other, of the first side plate and/or a joint of the first part and the second part, which are perpendicularly connected with each other, of the second side plate are/is rounded corners.

12. An elastic connector, comprising:

an upper contact part, a first side plate, a first S-shaped lift force arm and a bottom plate, wherein:

the first side plate comprises a first part of the first side plate and a second part of the first side plate, the first part and the second part of the first side plate are perpendicularly connected with each other, the first part of the first side plate is in an L shape and has a short edge with an end connected with the bottom plate and a long edge with an end connected with the first S-shaped lift force arm, and an outer side of the short edge of the first part the first side plate is connected with the second part of the first side plate; and wherein the bottom plate is provided with one or more through holes.

13. The elastic connector according to claim 12, wherein a joint of the first part and the second part, which are perpendicularly connected with each other, of the first side plate and/or a joint of the first part and the second part, which are perpendicularly connected with each other, of the second side plate are/is rounded corners.

* * * * *